US007047689B2

(12) United States Patent
Tipping

(10) Patent No.: US 7,047,689 B2
(45) Date of Patent: May 23, 2006

(54) TROLLING BOARD STORAGE DEVICE

(75) Inventor: Jerome E. Tipping, Milton, WI (US)

(73) Assignee: Angeler's Pride Specialties, Milton, WI (US)

( * ) Notice: Subject to any disclaimer, the term of this patent is extended or adjusted under 35 U.S.C. 154(b) by 0 days.

(21) Appl. No.: 10/438,554

(22) Filed: May 15, 2003

(65) Prior Publication Data

US 2004/0237377 A1 Dec. 2, 2004

(51) Int. Cl.
*A01K 97/06* (2006.01)

(52) U.S. Cl. ..... 43/54.1; 206/315.11; 211/85.7

(58) Field of Classification Search ..... 43/1, 43/54.1, 57.1, 4; 220/485, 491, 494, 476, 220/480, 482; 206/315.1, 315.11; 211/70.8, 211/85.7, 85.31, 90.03, 113, 119, 126.9
See application file for complete search history.

(56) References Cited

U.S. PATENT DOCUMENTS

| | | | | |
|---|---|---|---|---|
| 2,956,689 | A * | 10/1960 | Van Der Togt | 211/86.01 |
| 3,018,897 | A | 1/1962 | Carlyle | 211/60 |
| 3,628,204 | A | 12/1971 | Hoffman, Jr. | 9/1 |
| 3,805,722 | A | 4/1974 | Melchert, Jr. et al. | 114/5 |
| 3,877,580 | A * | 4/1975 | Hammar | 211/184 |
| 3,923,187 | A * | 12/1975 | Johansson et al. | 220/491 |
| 4,372,243 | A | 2/1983 | Roope, Jr. | 114/364 |
| 4,456,125 | A * | 6/1984 | Chap | 206/513 |
| 4,524,538 | A | 6/1985 | Halvorsen | 43/43.13 |
| 4,526,285 | A * | 7/1985 | Cerveny et al. | 220/7 |

(Continued)

FOREIGN PATENT DOCUMENTS

| | | | |
|---|---|---|---|
| DE | 29617253 | * | 2/1997 |

(Continued)

OTHER PUBLICATIONS

'The Planer Tamer'. The driftbag.com website, Jan. 22, 2002 [retrieved on May 25, 2004]. Retrieved from the internet: <URL: web.archive.org/web/20011201185547/driftbag.com/planer.htm>.*

*Primary Examiner*—Peter M. Poon
*Assistant Examiner*—David Parsley
(74) *Attorney, Agent, or Firm*—Whyte Hirschboeck Dudek SC

(57) ABSTRACT

This disclosure describes a trolling board storage device. The device includes a wire frame bent to create a trolling board storage area for storing at least one trolling board. The wire frame includes a generally U-shaped portion comprising a plurality of generally parallel U-shaped wires, the plurality of generally parallel U-shaped wires connected by a pair of wires that are positioned generally perpendicular to the plurality of generally parallel U-shaped wires. The device further includes a generally L-shaped portion connected to the U-shaped portion, the generally L-shaped portion comprising a plurality of generally parallel L-shaped wires, the plurality of generally parallel L-shaped wires connected by a wire that is positioned generally perpendicular to the plurality of generally parallel L-shaped wires. In one embodiment, the wire frame a trolling board extension clearance channel. The device can promote proper drying of the typically wet or damp trolling boards.

6 Claims, 6 Drawing Sheets

U.S. PATENT DOCUMENTS 4,646,929 A * 3/1987 Plissonneau et al. ..... 220/491
4,671,009 A 6/1987 Faunce ..... 43/54.1
4,703,580 A * 11/1987 Kammeraad ..... 43/43.13
4,848,620 A * 7/1989 Chap ..... 220/491
5,172,885 A * 12/1992 Kreischer ..... 248/539
5,341,591 A 8/1994 Hicks ..... 43/43.13
5,379,536 A * 1/1995 Lorenzana ..... 38/106
5,443,173 A * 8/1995 Emery et al. ..... 220/6
5,454,342 A 10/1995 Colquett et al. ..... 114/364
5,871,115 A * 2/1999 Kohn ..... 220/485
6,105,305 A 8/2000 Edens ..... 43/54.1

6,491,173 B1 12/2002 Costa ..... 211/126.15 JP 8-140871 * 6/1996

FOREIGN PATENT DOCUMENTS * cited by examiner

GB 2154858 * 9/1985

TROLLING BOARD STORAGE DEVICE

FIELD AND BACKGROUND OF THE INVENTION

The invention relates generally to boating equipment and more particularly to a trolling board storage device.

In the maritime arena, trolling boards, also known as trollers, planer boards and outrigger floats, are commonly used to float near a boat or fishing vessel and receive and maintain the integrity of numerous fishing lines extending from the fishing vessel. The boat tows the trolling boards with tow lines in a conventional manner. Typically, the towing line is attached to the trolling board by a trolling arm, as well as to the fishing lines. The fishing lines can be subsequently disengaged from the towing line as desired, for example, when reacting to a strike on one of the fishing lines.

Trolling boards, as maritime equipment, are often stored directly on the boat from which the fishing lines will be cast so as to be readily available to a user. In most cases, storage of the trolling boards occurs in a variable or ad hoc basis, by which any particular container, hold or holding area on the boat is utilized to store the trolling board. Since trolling boards are not generally considered when designing boats, there is not a holding or securing apparatus specifically made for trolling boards and that can be used on a boat. Consequently, damage to holding areas not designed for trolling boards, as well as damage to tow arms or other trolling board parts occurs from improper storage of the trolling boards. Moreover, the trolling boards tend to lay or be stored so as to clutter useable and limited space on a boat.

In addition, trolling boards are typically stored shortly after use, and as such they are stored typically when wet, or at least damp.

Accordingly, a need exists in the marketplace for a device that can specifically hold and secure one or more trolling boards, a device that can promote proper drying of the typically wet or damp boards, so that the boards may be properly maintained for long term use.

BRIEF SUMMARY OF THE INVENTION

Disclosed herein is a trolling board storage device for use with at least one trolling board, the device comprising a wire frame bent to create a trolling board storage area for storing at least one trolling board.

In one embodiment, the wire frame comprises: a generally U-shaped portion comprising a plurality of substantially parallel U-shaped wires, the plurality of substantially parallel U-shaped wires connected by a pair of wires that are positioned substantially perpendicular to the plurality of substantially parallel U-shaped wires; and a generally L-shaped portion connected to the U-shaped portion, the substantially L-shaped portion comprising a plurality of substantially parallel L-shaped wires, the plurality of substantially parallel L-shaped wires connected by a wire that is positioned substantially perpendicular to the plurality of substantially parallel L-shaped wires.

In another embodiment, the wire frame further defines at least one trolling board extension clearance channel, the channel for receiving an extension attached to the at least one trolling board.

According to another aspect, disclosed herein is trolling board storage device in combination with at least one trolling board, the combination comprising: a wire frame bent to create a trolling board storage area; and at least one trolling board for secured placement at least partially within the trolling board storage area.

According to still another aspect of the present invention, trolling board storage kit comprising: a trolling board storage device comprising a wire frame bent to create a trolling board storage area for securing at least one trolling board; and mounting hardware packaged with the device, the hardware for mounting the device one of directly and indirectly to a boat.

Other embodiments, objects, aspects, and advantages of the present invention will become apparent upon a reading of the detailed description that follows, including the claims, in view of the drawings.

BRIEF DESCRIPTION OF THE DRAWINGS

The drawings illustrate the best mode presently contemplated for carrying out the invention.

In the drawings.

DETAILED DESCRIPTION OF THE INVENTION

Figure 1:
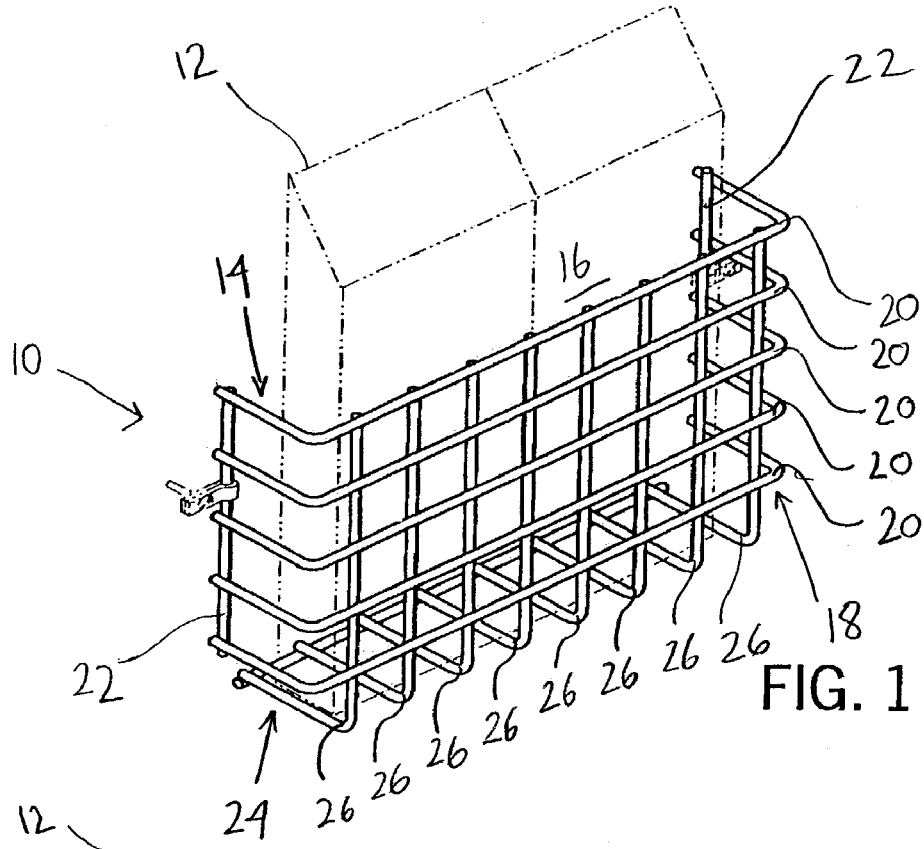
FIG. 1 is a perspective of one embodiment of a trolling board storage device according to one aspect of the present invention.
Figure 2:
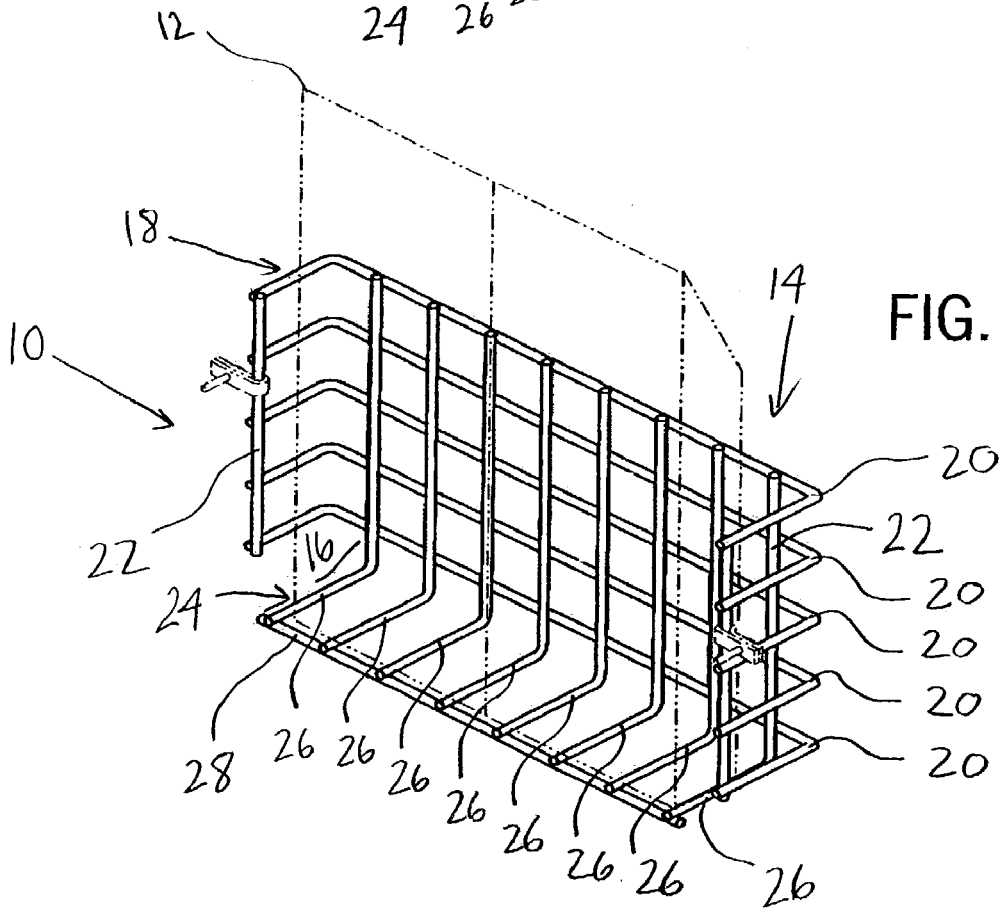
FIG. 2 is a reverse perspective view of the trolling board storage device of FIG. 1.

FIGS. 1 and 2 are perspective and reverse perspective views, respectively, of one embodiment of a trolling board storage device 10 according to one aspect of the present invention. Device 10 is designed for use with at least one trolling board 12 (a plurality of which are shown in phantom). The device comprises a wire frame 14 that is bent to create a trolling board storage area 16 for secured placement of a trolling board therein.

The trolling board storage device, in the embodiments illustrated herein, are sized to accommodate two trolling boards. However, it is contemplated that the exact dimensions of the device can be varied to accommodate any desired number of trolling boards.

Wire frame 14 of trolling board storage device 10 includes a generally U-shaped portion 18 comprising a plurality of substantially parallel U-shaped wires 20. The plurality of substantially parallel U-shaped wires 20 connected by a pair of wires 22 that are positioned substantially perpendicular to the plurality of substantially parallel U-shaped wires. A generally L-shaped portion 24 is connected to the U-shaped portion 18. The substantially L-shaped portion 24 comprises a plurality of substantially parallel L-shaped wires 26 and the plurality of substantially parallel L-shaped wires are connected by a wire 28 that is positioned substantially perpendicular to the plurality of substantially parallel L-shaped wires. As shown, the connection between the generally U-shaped portion and the generally L-shaped portion results in an overlay relationship between the generally L-shaped portion and the generally U-shaped portion.

Figure 3:
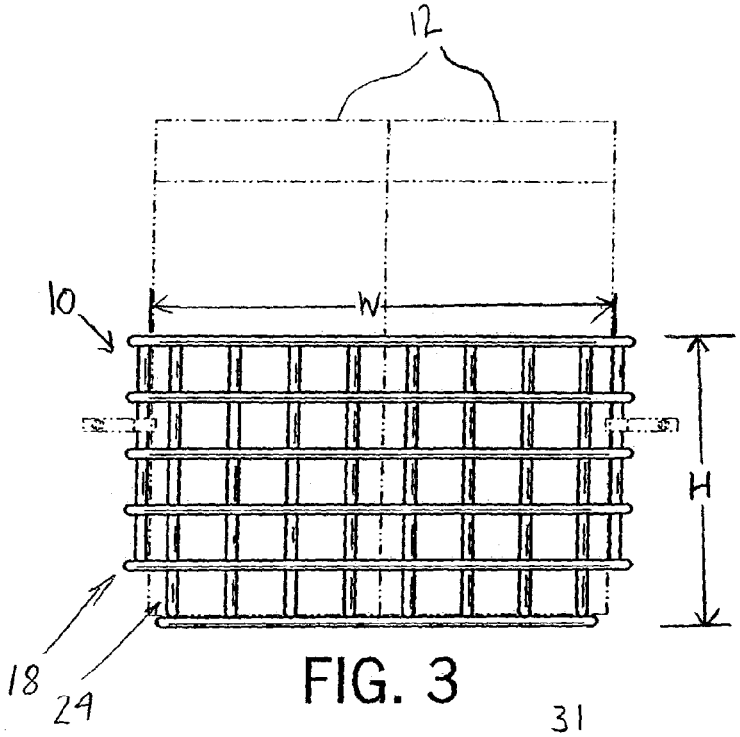
FIG. 3 is a front view of the trolling board storage device of FIG. 1.
Figure 4:
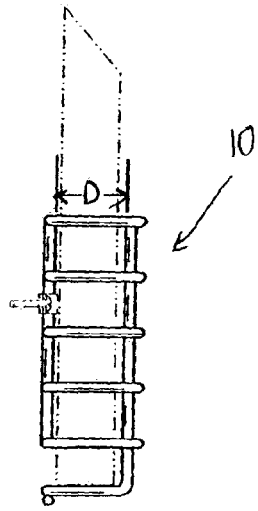
FIG. 4 is a left side elevational view of the trolling board storage device of FIG. 1.

FIGS. 3 and 4 are front and left side elevational views of the trolling board storage device of FIG. 1. Here, it can be seen that generally U-shaped portion 18 overlays the generally L-shaped portion 24 to create a mesh, or grid-like latticework. In the embodiment shown, the overall width W of the latticework is about 9 inches, the overall depth D is about 1.25 inches, and the height H is about 5 inches. These dimensions result in a size of device 10 that can readily accommodate 2 trolling boards 12 for storage. Exemplary trolling boards that can be stored in the trolling board storage device in this embodiment are the Off Shore, Willie, and Yellow Bird types of trolling boards. Off Shore boards are available from Off Shore Tackle, located in Port Austin, Mich., and Yellow Bird boards are available from Ed Shirley Sports, located in Chicago, Ill.

The latticework provides a support and storage structure for trolling boards before and following use. Advantageously, the latticework provides a means for air to pass over the boards which are typically wet following use. In general, the latticework can be made of steel or other suitable material (i.e., a material that can provide the requisite strength, malleability, endurance). In one embodiment, the wire frame can be coated with, for example, a polyarmor coating or other coating to provide benefits such as corrosion prevention, increased product life of the storage device, among others.

Figure 5:
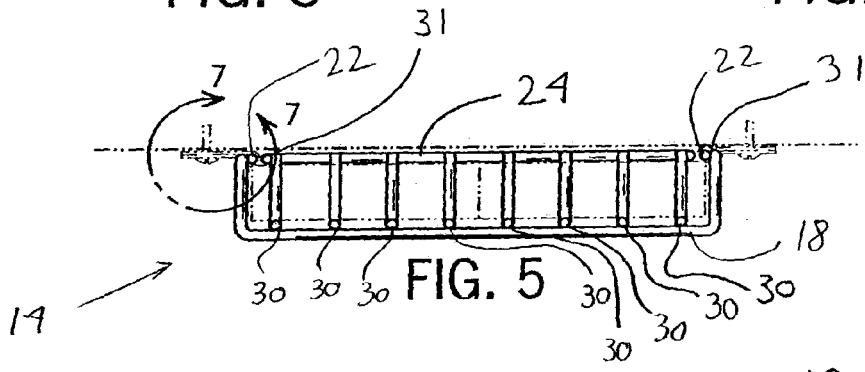
FIG. 5 is a top plan view of the trolling board storage device of FIG. 1.
Figure 6:
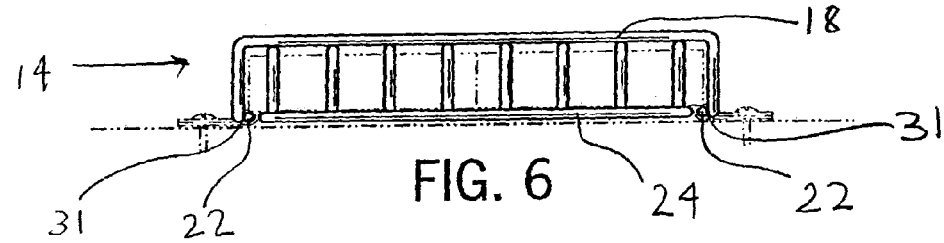
FIG. 6 is a bottom plan view of the trolling board storage device of FIG. 1.

FIGS. 5 and 6 are top and bottom plan views, respectively, of the trolling board storage device of FIG. 1. As can be clearly seen in this view, the generally U-shaped portion 18 and the generally L-shaped portion 24 are connected via a plurality of connection points 30 to create the wire frame 14. In addition, parallel end wires 22 are connected by connection points 31 (although not shown, end wire for connecting at connection points the L-shaped wires). In one preferred embodiment, connection points are welded connection, and as such, the wire frame can be termed a "welded wire frame". In a preferred embodiment, the welded wire frame, and more particularly, the wire of the welded wire frame, is steel.

Figure 7:
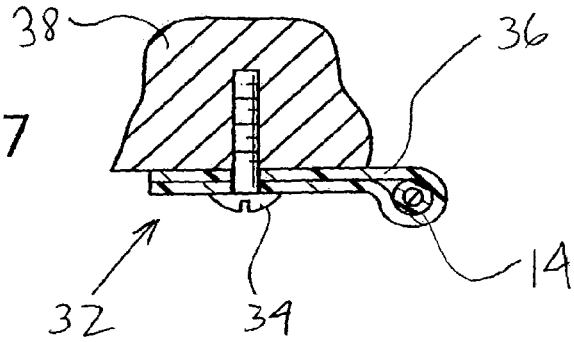
FIG. 7 is a enlarged sectional taken along line 7—7 of FIG. 5.

FIG. 7 is an enlarged sectional view taken along line 7—7 of FIG. 5. Mounting hardware 32, which can include a screw 34 and a clip 36, typically made of steel, is shown connected to wire frame 14, for mounting the frame, and in generally the storage device, to a structure 38 (e.g., a boat, a storage locker, a rod locker, or other container, etc.) for secure placement. Connection between the mounting hardware and wire frame can be varied in its location to convenience.

Figure 8:
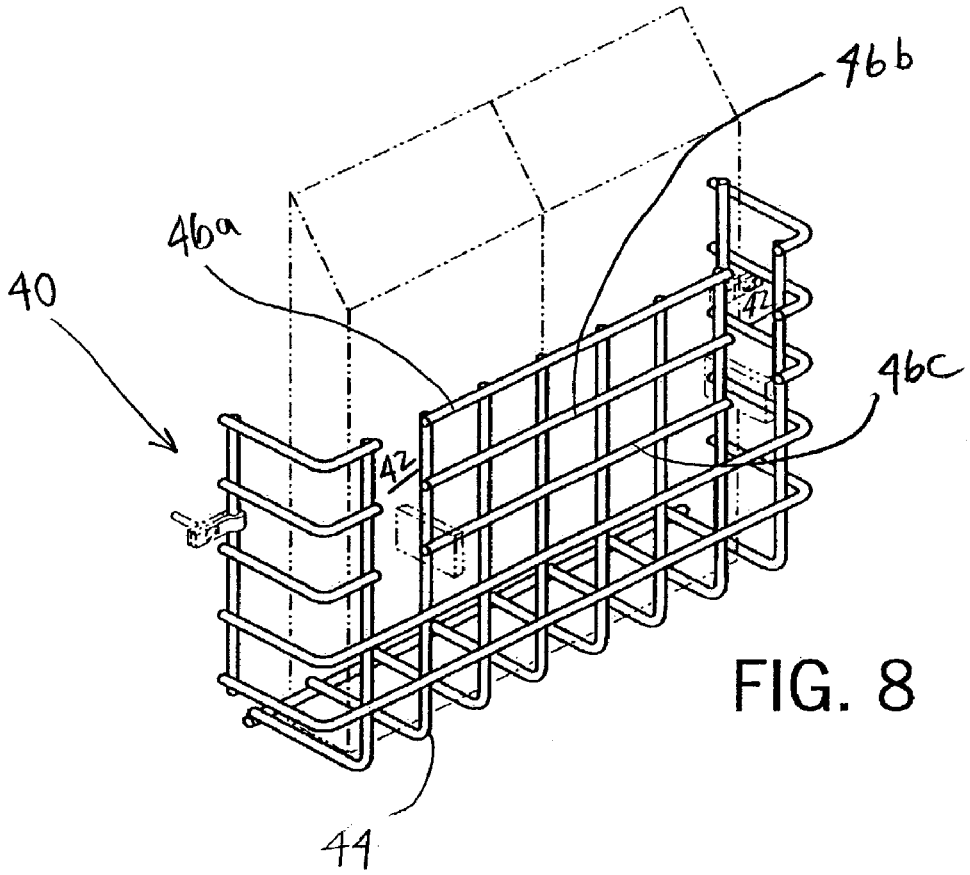
FIG. 8 is a perspective view of another embodiment of a trolling board storage device according to one aspect of the present invention.
Figure 9:
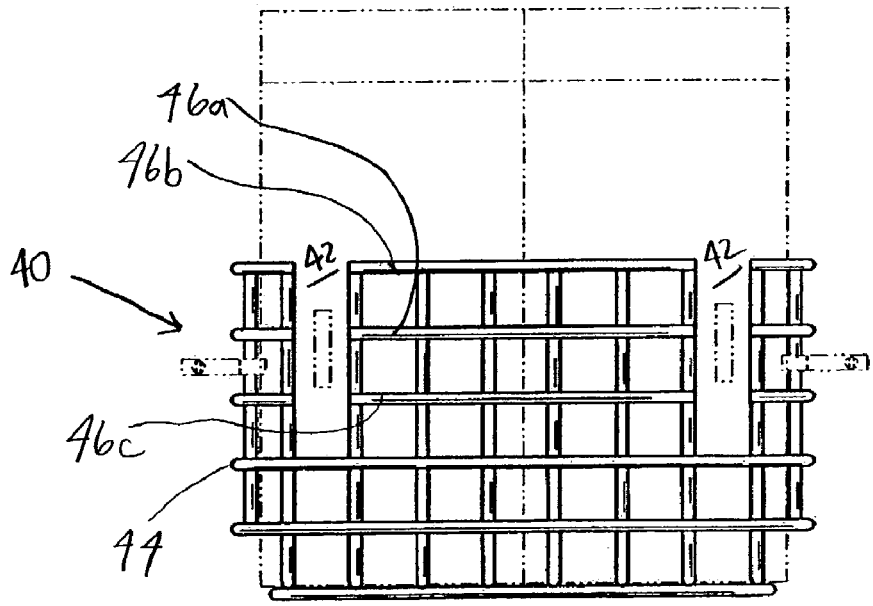
FIG. 9 is a front view of the trolling board storage device of FIG. 8.

FIG. 8 is a perspective view of another embodiment of a trolling board storage device according to one aspect of the present invention, and FIG. 9 is a front view of the trolling board storage device of FIG. 8. Many trolling boards include shelf brackets or other hardware to which the planer release is attached. Because of the additional hardware attached to the trolling board, any storage device for the trolling boards should accommodate the additional hardware so that the trolling board is not damaged by improperly forcing the trolling board into an inadequate space. To that end, trolling board storage device 40 includes, in the embodiment illustrated, a pair trolling board extension clearance channels 42. The channels are formed within the storage device 40, and specifically, in the frame 44 of the device. In one embodiment, the channels 42 can be created by removing portions of wires 46*a–c*, or put another way, each trolling board extension clearance channel can extend across three of the substantially parallel U-shaped wires 46*a–c*. In general, it is contemplated that the channels can be sized and shaped to convenience, and accommodate the trolling board(s) that is intended to be stored therein. Exemplary trolling boards that can be stored in the trolling board storage device shown in this embodiment are the Mr. Walleye and the Rover types of trolling boards. Mr. Walleye boards are available from Church Tackle, located in Sodus, Mich.

In one embodiment, the portions of wires are removing by a clipping or cutting operation. Accordingly, in one embodiment, three wire portions can be removed to create each channel. In another embodiment, the clearance channels can be formed by creating discrete body or wire frame portions, and connecting those portions together.

Figure 10:
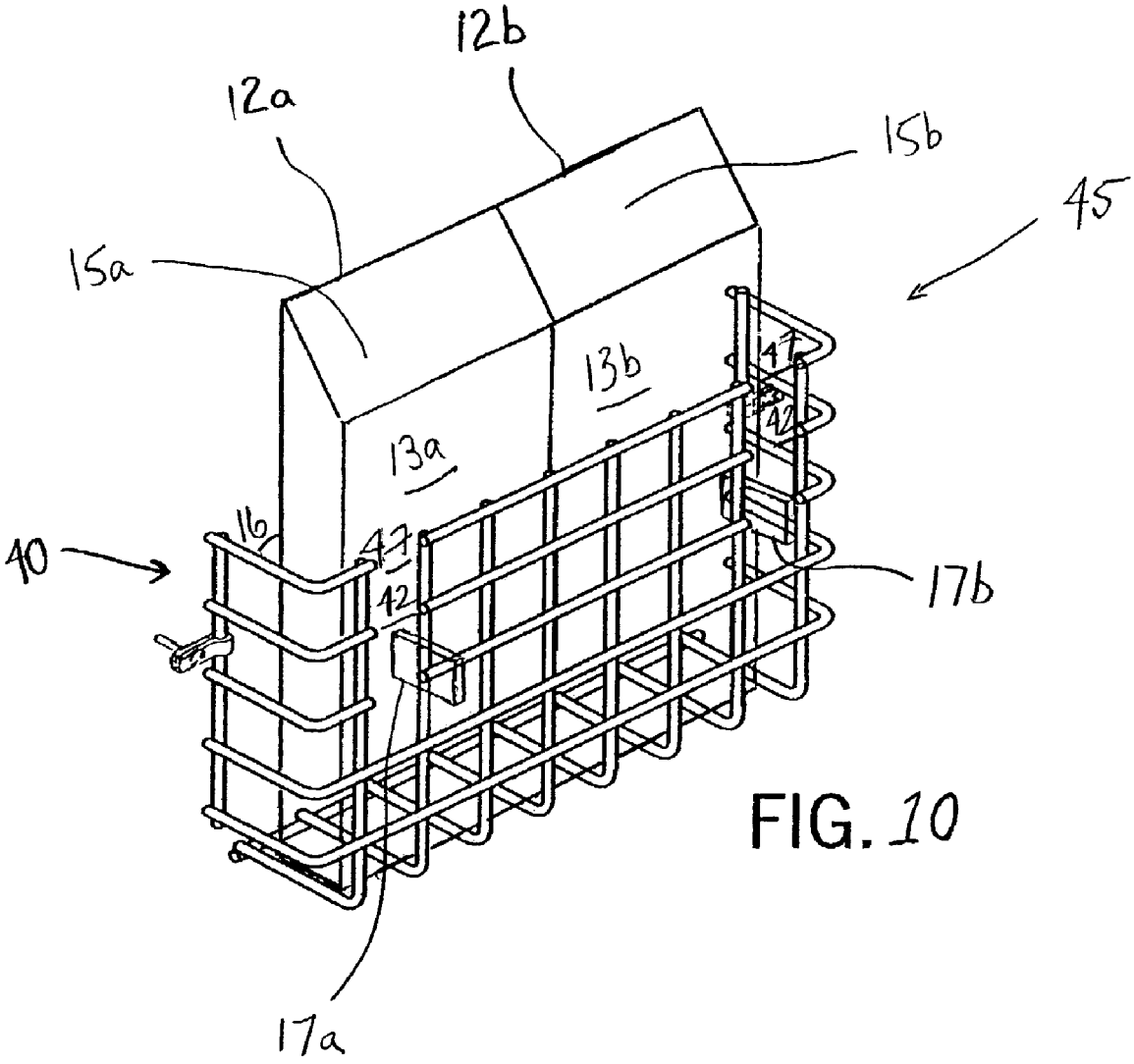
FIG. 10 is a perspective view of a trolling board storage device in combination with a trolling board according to one aspect of the present invention.

FIG. 10 is a perspective view of trolling board storage device 40 shown in combination with a trolling boards 12*a–b*, according to one aspect of the present invention. Together, the device and boards create a combination 45. As shown, the trolling boards are positioned within, and substantially fill, the trolling board storage area previously described with reference to FIGS. 1 and 2. Trolling boards typically include a straight portion 13*a–b* and an angled portion 15*a–b*. As illustrated, the storage device 40 provides for secure placement of the trolling boards by securing at least a portion of the straight trolling board portions 13*a–b*, while permitting the angled portions 15*a–b* to extend out from the trolling board storage, thereby facilitating easy removable by a user. Trolling boards 12*a–b* include extensions 17*a–b* which are brackets to which planer releases can be attached. As shown, the extensions are connected to straight trolling board portions 13*a–b* and reside in trolling board extension clearance channels 42 after passing the channel thresholds 47, which are disposed at the upper end of the channels. Each trolling board extension clearance channel typically extends in a substantially vertical direction when the device is mounted.

Figure 11:
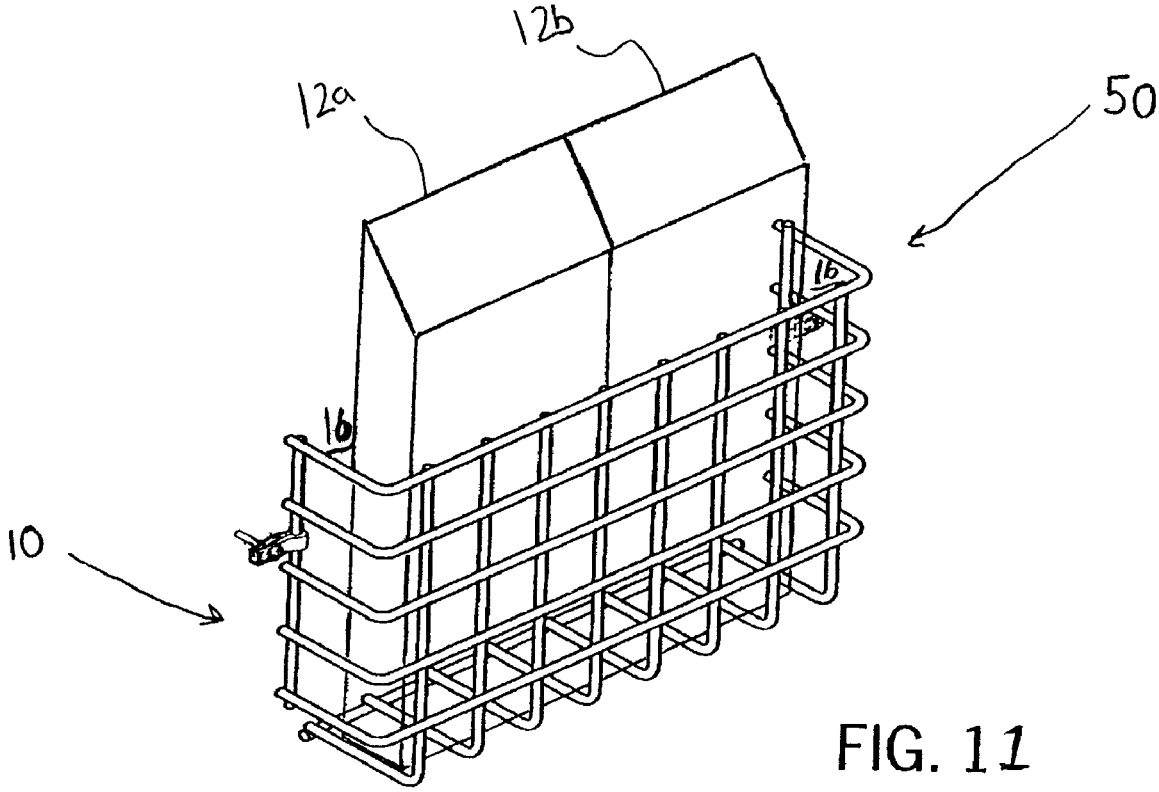
FIG. 11 is a perspective view of another embodiment of the trolling board storage device in combination with a trolling board according to one aspect of the present invention.

FIG. 11 is a perspective view of another embodiment of a trolling board storage device 10 in combination with, as shown, a pair of trolling boards 12*a–b* according to one aspect of the present invention. Together the device and boards make up combination 50. Here again, trolling boards 12*a–b* are positioned within storage area 46 of the storage device 10. In this and in other contemplated embodiments, one advantage of the present invention is that the water on the boards following use can easily drain away, such that drying can occur more rapidly.

Figure 12:
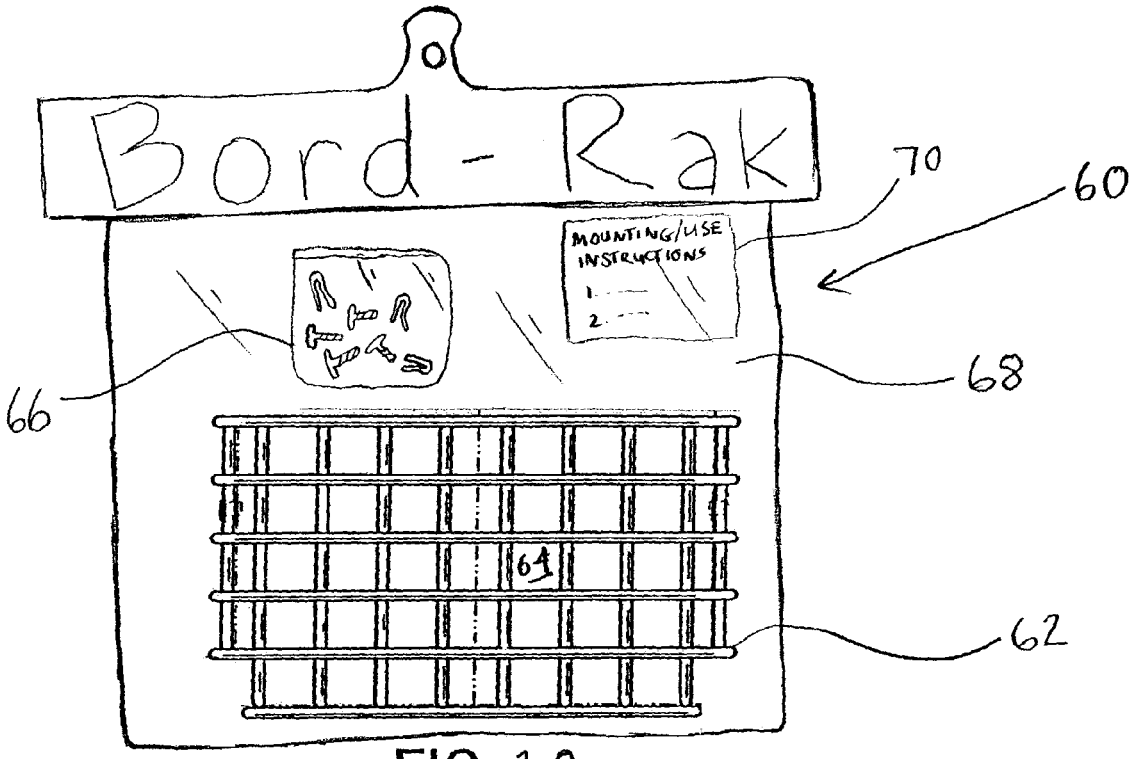
FIG. 12 is a trolling board storage kit according to one aspect of the present invention.

FIG. 12 is a trolling board storage kit 60 according to one aspect of the present invention. The trolling board storage kit 60 includes a trolling board storage device 62 having a wire frame bent to create a trolling board storage area 64 that can be used for securing at least one trolling board (boards 12*a–b* of FIGS. 10–11). Also shown and included in the kit 60 is mounting hardware 66 which can be packaged using packaging 68 (e.g., a plastic wrapping material) with the device 62. The hardware can be used to mount the device either directly or indirectly to a boat. Again, the device can be indirectly mounted or secured to a boat by mounting the trolling board storage device, for example, to a storage locker securably positioned in the boat. A standard kit can also include such ancillary items as instructions for use and/or mounting 70.

The present invention has been described in terms of preferred embodiments. Equivalents, alternatives, and modifications, aside from those expressly stated herein, are possible and should be understood to be within the scope of the appending claims.

What is claimed is:

1. A trolling board storage device in combination with a trolling board the combination comprising:

a trolling board having an extension attached to the trolling board and extending generally perpendicularly therefrom:

a storage device comprising a wire frame bent to create a trolling board storage area for storing the trolling board, the wire frame comprising:

a generally U-shaped portion comprising a plurality of generally parallel U-shaped wires, the plurality of generally parallel U-shaped wires connected by a pair of wires that are positioned generally perpendicular to the plurality of generally parallel U-shaped wires; and a generally L-shaped portion connected to the U-shaped portion, the generally L-shaped portion comprising a plurality of generally parallel L-shaped wires, the plurality of generally parallel L-shaped wires connected by a wire that is positioned generally perpendicular to the plurality of generally parallel L-shaped wires;

wherein the generally L-shaped portion and the generally U-shaped portion are in overlay relationship with each other;

wherein the wire frame defines at least one trolling board extension clearance channel, the channel beginning at and extending from a location corresponding to an uppermost end of the wire frame to create a space that is void of any U-shaped wires, the channel for receiving an extension attached to the at least one trolling board; and wherein trolling board is adapted to extend substantially entirely through the extension of the trolling board is adapted to extend substantially entirely through extension clearance channel when the trolling board is contained in the storage device.

2. The device of claim 1 wherein the wire frame defines at least two trolling board extension clearance channels.

3. The device of claim 1 wherein the at least one trolling board extension clearance channel extends across three of the generally parallel U-shaped wires.

4. The device of claim 1 wherein each trolling board extension clearance channel extends in a generally vertical direction when the device is mounted.

5. The device of claim 1 wherein the generally L-shaped portion and the generally U-shaped portion are in overlay relationship with each other.

6. The device of claim 1 wherein the wire frame is a welded wire frame and the wire of the welded wire frame is made of steel.

* * * * *